US007311214B2

(12) United States Patent
Zinter, Jr.

(10) Patent No.: US 7,311,214 B2
(45) Date of Patent: Dec. 25, 2007

(54) CLEAN ROOM CRANE ASSEMBLY

(75) Inventor: Lawrence W. Zinter, Jr., Saratoga Springs, NY (US)

(73) Assignee: Zinter Handling, Inc., Saratoga Springs, NY (US)

( * ) Notice: Subject to any disclaimer, the term of this patent is extended or adjusted under 35 U.S.C. 154(b) by 115 days.

(21) Appl. No.: 10/931,866

(22) Filed: Sep. 1, 2004

(65) Prior Publication Data

US 2006/0043043 A1 Mar. 2, 2006

(51) Int. Cl.
*B66C 13/00* (2006.01)

(52) U.S. Cl. ..... 212/330; 212/271; 212/319

(58) Field of Classification Search ..... 212/319, 212/333–335, 330, 331, 271
See application file for complete search history.

(56) References Cited

U.S. PATENT DOCUMENTS

| | | | | | |
|---|---|---|---|---|---|
| 107,695 | A * | 9/1870 | Linderman | ..... | 212/312 |
| 167,401 | A * | 9/1875 | Harrison | ..... | 104/119 |
| 1,731,897 | A * | 10/1929 | Hegarty et al. | ..... | 212/339 |
| 3,428,298 | A * | 2/1969 | Powell | ..... | 254/331 |
| 4,194,615 | A * | 3/1980 | Tell et al. | ..... | 198/524 |
| 5,733,096 | A * | 3/1998 | Van Doren et al. | ..... | 414/744.3 |
| 6,082,949 | A * | 7/2000 | Rosenquist | ..... | 414/217 |
| 6,766,895 | B2 * | 7/2004 | Matsumura | ..... | 198/495 |
| 7,004,076 | B2 * | 2/2006 | Traubenkraut et al. | ..... | 104/111 |
| 2005/0079041 | A1 * | 4/2005 | Campbell et al. | ..... | 414/626 |

FOREIGN PATENT DOCUMENTS

| | | | |
|---|---|---|---|
| JP | 63-219135 | * | 9/1988 |
| JP | 2000-243808 | * | 9/2000 |
| JP | 2002-156190 | * | 5/2002 |
| WO | 2004-063080 | * | 7/2004 |

* cited by examiner

*Primary Examiner*—Thomas J. Brahan
(74) *Attorney, Agent, or Firm*—Heslin Rothenberg Farley & Mesiti P.C.; Victor A. Cardona, Esq.

(57) ABSTRACT

A hoist assembly for use in a clean room includes a hoist body which is received in a hoist cover cavity of a hoist cover. A rigging is coupled to a winch of the hoist body and to an attaching member attachable to a load. The rigging is received in a rigging cavity of a rigging cover and the rigging cover is extendable in response to an extension of the rigging from the hoist body and retractable in response to a retraction of the rigging.

15 Claims, 13 Drawing Sheets

AIRBORNE PARTICULATE CLEANLINESS CLASSES

Class limits are given for each class name. The limits designate specific concentrations (particles per unit volume) of airborne particles with sizes equal to and larger than the particle sizes shown*

| Class Name ** | | Class limits | | | | | | | | | |
|---|---|---|---|---|---|---|---|---|---|---|---|
| | | 0.1 m | | 0.2 m | | 0.3 m | | 0.5 m | | 5 m | |
| | | Volume units | | Volume units | | Volume units | | Volume units | | Volume units | |
| SI | English*** | ($m^3$) | ($ft^3$) | ($m^3$) | ($ft^3$) | ($m^3$) | ($ft^3$) | ($m^3$) | ($ft^3$) | ($m^3$) | ($ft^3$) |
| M1 | | 350 | 9.91 | 75.7 | 2.14 | 30.9 | 0.875 | 10.0 | 0.283 | – | – |
| M1.5 | 1 | 1,240 | 35.0 | 265 | 7.50 | 106 | 3.00 | 11.0 | 1.00 | – | – |
| M2 | | 3,500 | 99.1 | 757 | 21.4 | 309 | 8.75 | 100 | 2.83 | – | – |
| M2.5 | 10 | 12,400 | 350 | 2,650 | 75.0 | 1,060 | 30.0 | 353 | 10.0 | – | – |
| M3 | | 35,000 | 991 | 7,570 | 214 | 3,090 | 87.5 | 1,000 | 28.3 | – | – |
| M3.5 | 100 | - | - | 26,500 | 750 | 10,600 | 300 | 3,530 | 100 | – | – |
| M4 | | - | - | 75,700 | 2,140 | 30,900 | 875 | 10,000 | 283 | – | – |
| M4.5 | 1,000 | - | - | - | - | - | - | 35,300 | 1,000 | 247 | 7.00 |
| M5 | | - | - | - | - | - | - | 100,000 | 2,830 | 618 | 17.5 |
| M5.5 | 10,000 | - | - | - | - | - | - | 353,000 | 10,000 | 2,470 | 70.0 |
| M6 | | - | - | - | - | - | - | 1000,000 | 28,300 | 6,180 | 175 |
| M6.5 | 100,000 | - | - | - | - | - | - | 3530,000 | 100000 | 24,700 | 700 |
| M7 | | - | - | - | - | - | - | 10000000 | 283000 | 61,800 | 1,750 |

* The class limits shown in Table I are defined for classification purposes only and do not necessarily represent the size distribution to be found in any particular situation.

**Concentration limits for intermediate classes can be calculated, approximately, from the following equations:

$$\text{particles}/m^3 = 10^M(0.5/d)^{2.2}$$

where M is the numerical designation of the class based on SI units, and d is the particle size in micrometers, or $$\text{particles}/ft^3 = N_c(0.5/d)^{2.2}$$

where $N_c$ is the numerical designation of the class based on English (U. S. customary) units, and d is the particle size in micrometers.

*** For naming and describing the classes, SI names and units are preferred; however, English (U.S. customary) units may be used.

FIG. 10

CLEAN ROOM CRANE ASSEMBLY

FIELD OF THE INVENTION

The present invention relates generally to the construction of overhead cranes and portions thereof, and more particularly to cranes and hoists for use in clean rooms.

BACKGROUND OF THE INVENTION

An overhead traveling crane may be utilized to move loads within a building or other structure. Such cranes may use structural ceiling beams of a building to travel along, for example. The ambient environment in which such cranes operated typically did not require a crane to be configured to minimize emission of contaminants into the crane's ambient environment. For example, hoists of prior art cranes were not configured to prevent oils, lubricants, and other contaminants from being emitted to such an ambient environment.

The use of hoists and cranes in clean rooms or clean zones for manufacturing certain products require that particular particulate cleanliness standards be met. Examples of such standards are outlined in "Federal Standard 209E Airborne Particulate Cleanliness Classes in Clean Rooms and Clean Zones", Institute of Environmental Sciences, 1992, which is incorporated herein by reference. Since it is sometimes necessary for cranes to operate in clean rooms and clean zones, it is desirable for cranes utilized therein to minimize the emission or production of particulates.

Thus, a need exists for cranes, which do not introduce contaminants or particulates into their ambient environment particularly when such cranes are located in clean rooms.

SUMMARY OF THE INVENTION

The present invention provides, in a first aspect, a hoist cover assembly for use in a clean room, which includes a hoist body cover and a rigging cover. The hoist body cover has a cavity configured to receive a hoist body. The rigging cover has a cavity configured to receive a rigging coupled to the hoist body and an attaching member attachable to a load. The rigging cover is extendable in response to an extension of the rigging from the hoist body and retractable in response to a retraction of the rigging.

The present invention provides, in a second aspect, a hoist assembly for use on a clean room crane. The hoist assembly includes a hoist body received in a cavity of a hoist cover. The rigging is coupled to the hoist body and to an attaching member attachable to a load. The rigging is received in a cavity of the rigging cover and the rigging cover is extendable in response to an extension of the rigging from the hoist body and retractable in response to a retraction of the rigging.

The present invention provides, in a third aspect, a rigging cover assembly for use with a hoist which includes a sleeve having a rigging cavity configured to envelop a rigging of a hoist coupled to an attaching member attachable to a load. The sleeve is connectable to a sleeve retainer of a hoist cover. The sleeve is extendable in response to an extension of the rigging from the hoist and retractable in response to a retraction of the rigging. The sleeve wall is configured to inhibit fluid communication between the sleeve cavity and an exterior of the sleeve wall.

The present invention provides, in a fourth aspect, a method for inhibiting contamination from passing from a hoist to a clean room. The method includes inserting a hoist body in a hoist cavity of a hoist cover. The hoist cover has walls configured to inhibit fluid communication between the hoist cavity and the clean room. A rigging of the hoist is inserted in a rigging cover cavity of a rigging cover connected to the hoist body to envelop the rigging. The rigging cover has a wall configured to inhibit fluid communication between the rigging cover cavity and the clean room.

BRIEF DESCRIPTION OF THE DRAWINGS

The subject matter which is regarded as the invention is particularly pointed out and distinctly claimed in the claims at the conclusion of the specification. The foregoing and other features, and advantages of the invention will be readily understood from the following detailed description of preferred embodiments taken in conjunction with the accompanying drawings in which:

FIG. 10 is a table taken from "Federal Standard 209E Airborne Particulate Cleanliness Classes in Clean Rooms and Clean Zones", which outlines particulate standards for clean room classes;

DETAILED DESCRIPTION OF THE INVENTION

Figure 1:
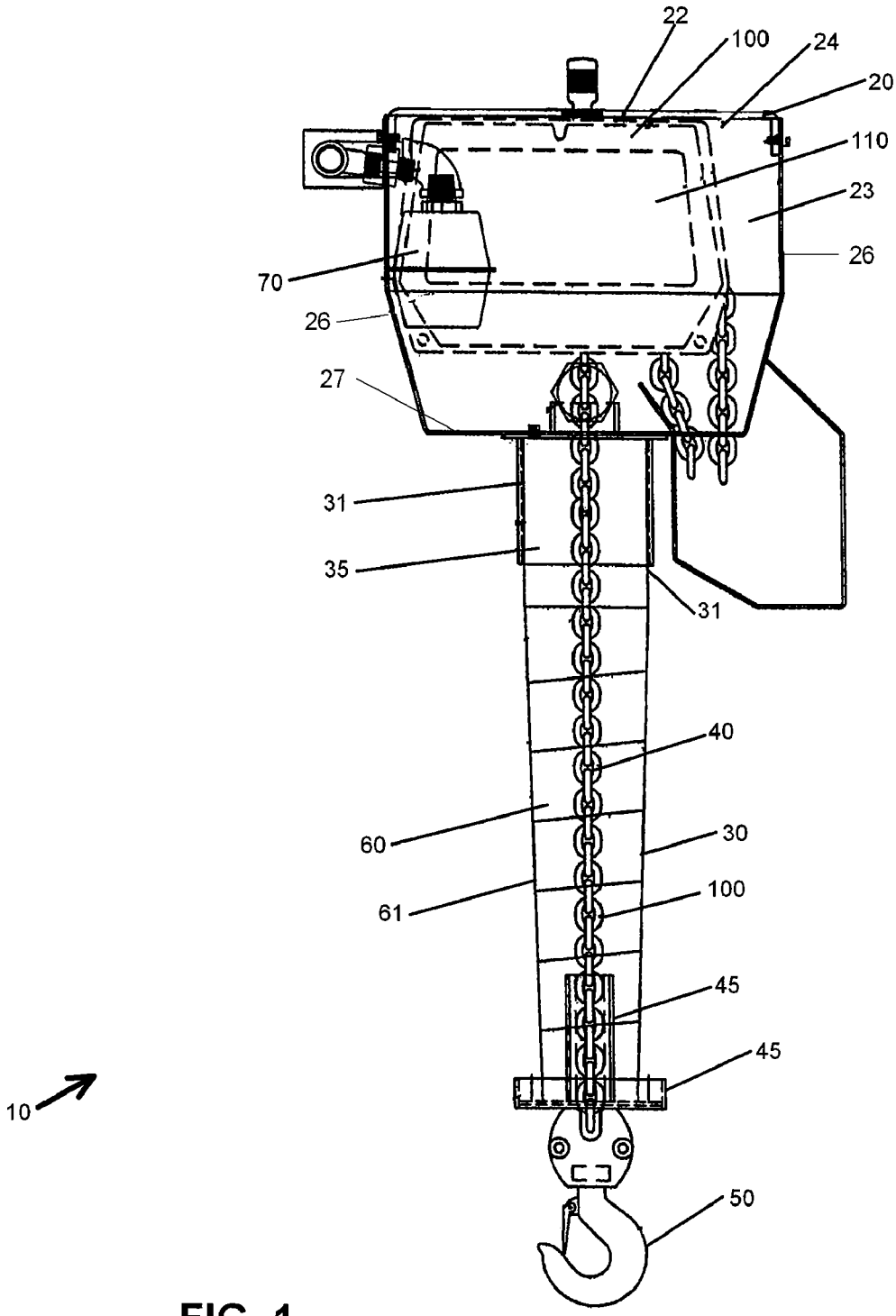
FIG. 1 is a side elevational view of a hoist cover assembly with the cable cover thereof in an extended position in accordance with the present invention.
Figure 2:
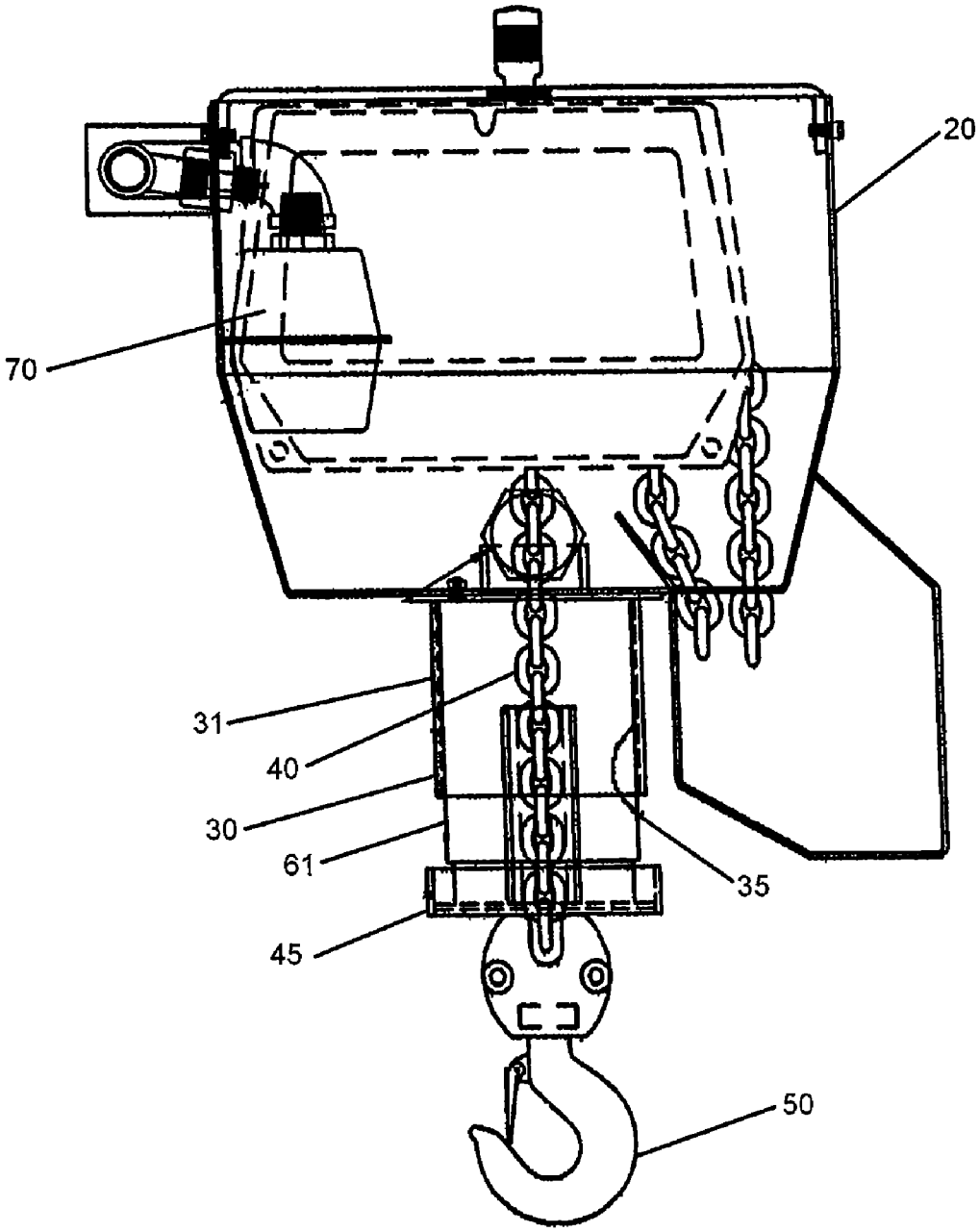
FIG. 2 is a side elevational view of the hoist cover assembly of FIG. 1 with the cable cover in a retracted position.
Figure 3:
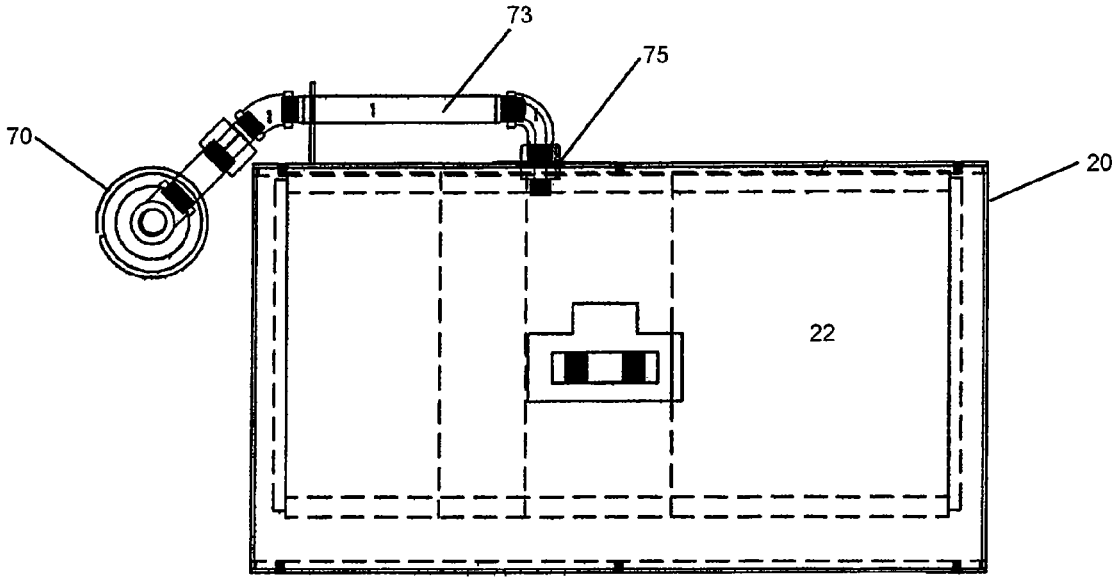
FIG. 3 is a plan view of the hoist cover assembly of FIG. 1.
Figure 4:
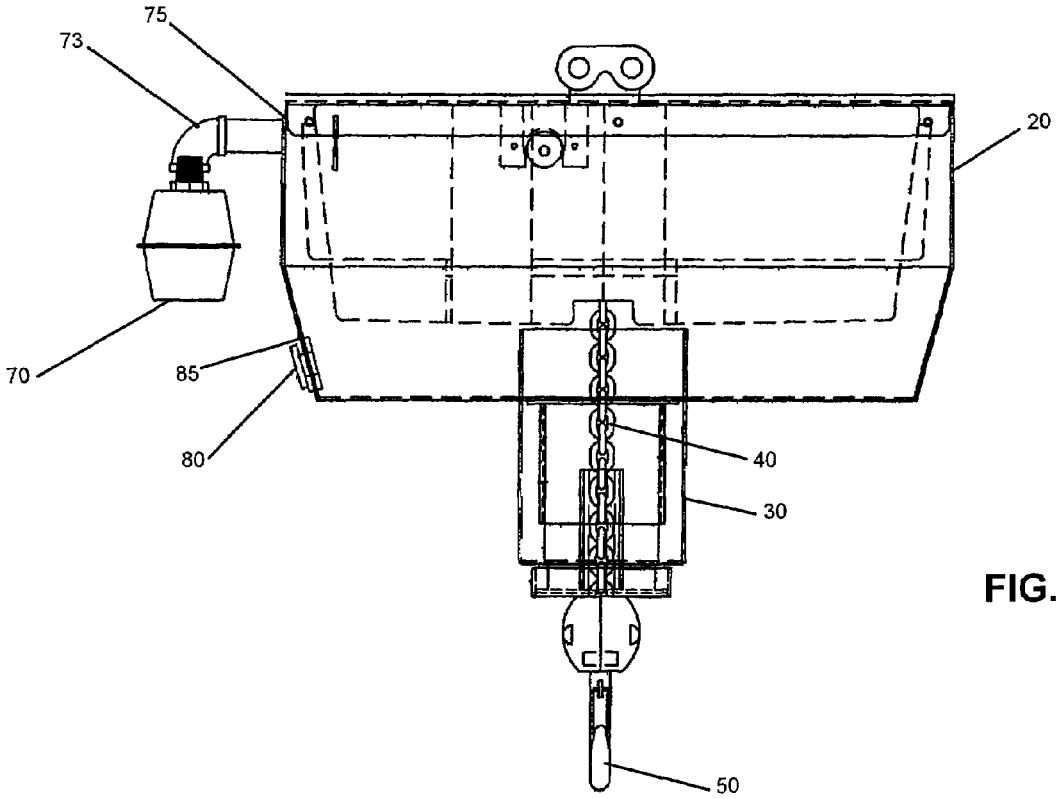
FIG. 4 is a front elevational view of the hoist cover assembly of FIG. 2.

In accordance with the principles of the present invention, a hoist assembly for use as a component of a clean room crane is provided. The hoist includes a hoist body received in a cavity of a hoist cover. A rigging is connected to the hoist body at one end and an attaching member attachable to a load at the opposite end. The rigging is received in a rigging cavity of a rigging cover connected to the hoist cover. The rigging cover is extendable in response to an extension of the rigging from the hoist body and retractable in response to a retraction of the rigging. The hoist cover and the rigging cover are configured to inhibit contamination from passing from an interior of the hoist cover and rigging cover to an exterior thereof.

FIGS. 1-4 depict a hoist cover assembly 10 which may include a hoist cover 20 and a rigging cover 30. Hoist cover 20 may be configured (e.g., shaped and dimensioned) to receive a hoist body 110 of a hoist 100. Hoist 100 also includes rigging 40 attached to an attaching member 50 (e.g., a hook). Hoist body 110 may also include a winch (not shown) configured to raise and lower rigging 40 which may be coupled to a load (not shown) via attaching member 50 to allow the load to be raised and lowered by the winch. Hoist cover 20 may include a lid 22 openable to allow hoist 100 to be received therein. Specifically, hoist body 110 may be received in a hoist cover cavity 23. A gasket (not shown) may be located between lid 22 and a lid engaging surface 24 of hoist cover 20 to seal hoist cover cavity 23 and inhibit contamination from passing therefrom into the ambient environment. Also, hoist cover 20 may include walls 26 and a bottom 27 defining hoist cover cavity 23. Further, hoist cover 20 may be formed of a material(s) (e.g., stainless steel) which inhibits, and avoids contributing to, movement of contamination (e.g., oils, lubricants, particulates, contaminated air) from passing therethrough thereby inhibiting contaminants from hoist 100 exiting hoist cover cavity 23 and/or entering the air of a clean room or clean space, for example.

Hoist cover 20 may also include an expansion chamber 70 connected to hoist body 110 (e.g., a gear box vent (not shown) thereof) at an opening 75 in hoist cover 20 by a conduit 73. In particular, expansion chamber 70 may include a canister or bladder (not shown), which may expand and contract based on an expansion or contraction of a volume of air in hoist body 110. For example, as the air in hoist body 110 is heated due to changes in air temperature around hoist 100 or heat created by the operation of hoist 100, the canister or bladder may expand to absorb the change in volume and pressure. In contrast, the bladder or canister may contract in response to the air in hoist body 110 being cooled or hoist 100 being shut down. The use of the expansion chamber 70 allows hoist body 110 to be self-contained by providing for the expansion and contraction of the gases (e.g., air) held therein without fluid communication with the external ambient environment. The self-contained nature of hoist cover body 110 thereby inhibits contamination (e.g., gaseous emissions from hoist body 110) from passing from hoist body 110 to an environment (e.g., a clean room) around hoist body 110 and hoist cover 20.

A sight glass 80 may be located in an opening 85 in hoist cover 20. Sight glass 80 may be transparent to allow a user to look therethrough to inspect hoist 100 and rigging 40 (e.g., hoist body 110) in hoist cover cavity 23. For example, the user may utilize sight glass 80 to inspect hoist 100 for leaks therein, such as for example, lubricants, oils, or fuel. Also, sight glass 80 may inhibit contamination (e.g., fluids or gases) from passing therethrough.

Rigging cover 30 is attached to hoist cover 20. Specifically, a top end 31 of rigging cover 30 is attached to a rigging cover retainer 35 of hoist cover 20. Rigging cover 30 includes a rigging cover cavity 60 configured (e.g., shaped and dimensioned) to receive rigging 40. Rigging cover 30 may include a wall 61 defining rigging cover cavity 60 and which is formed of a material (e.g., stainless steel) which inhibits, and avoids contributing to, movement of contamination (e.g., oils, lubricants, contaminated air) from passing therethrough as described above for hoist cover 20. The connection of rigging cover 30 to hoist cover 20 allows fluid communication between hoist cover cavity 23 and rigging cover cavity 60 while inhibiting movement of contaminants from hoist cover cavity 23 and rigging cover cavity 60 to an exterior thereof. Also, rigging cover 30 and hoist cover 20 can be formed of the same material or different materials, which inhibit contamination (e.g., particulates) from passing therethrough (e.g., TYVEK® material, TEFLON® material, ultra high molecular weight polyethylene). Further, any seams (e.g., at bolted or other mechanical connection points) in hoist cover 20, rigging cover 30, and/or between hoist cover 20 and rigging cover 30 may be covered with a clean room approved duct tape (e.g., Clean Room Duct Tape distributed by McMaster-Carr), as will be understood by those skilled in the art.

Rigging cover 30 also includes a rigging cover pilot 45 attachable to rigging 40. The attachment of pilot 45 to rigging 40 causes rigging cover 30 to move with the lowering or raising (i.e., extension or retraction) of rigging 40. In particular, as rigging 40 is lowered or extended by hoist body 10 (e.g., a winch thereof), rigging cover 30 telescopes or extends from hoist cover 20 due to the connection of pilot 45 to rigging 40. As rigging 40 is retracted or raised by the winch, rigging cover 30 is retracted. Pilot 45 may also be configured to collect fluids, which may leak from hoist 100, or rigging 40 and drip toward pilot 45.

Rigging cover 30 may be a telescoping sleeve or spring cover (e.g., a conical spring cover) as depicted in the figures. For example, a plurality of cylindrical sections of different sizes may be sealingly connected to one another such that rigging cover 30 as a whole may expand or contract telescopically based on forces placed thereon. Also, although rigging cover 30 is depicted as a telescoping sleeve, the rigging cover could be any type of sleeve, envelope, or other structure that has an interior configured to receive rigging and which includes extendable and retractable sides, which inhibit contamination from moving from rigging cover cavity 60 to an exterior thereof. For example, rigging cover 30, and portions thereof, could be flexible, rigid, or semi-rigid. Also, rigging cover pilot 45 could be attachable to attaching member 50 instead of rigging 40. Further, attaching member 50 could be formed of any material (e.g., stainless steel) which does not produce airborne particulates above the requirements for a clean room when used to connect cable 40 to loads to be raised, lowered, or otherwise manipulated. Also, rigging 40 could be any type of cable, cord, rope, wire rope, metal chain or other means of connecting a winch with a load to allow the winch to raise and/or lower such load.

Figure 5:
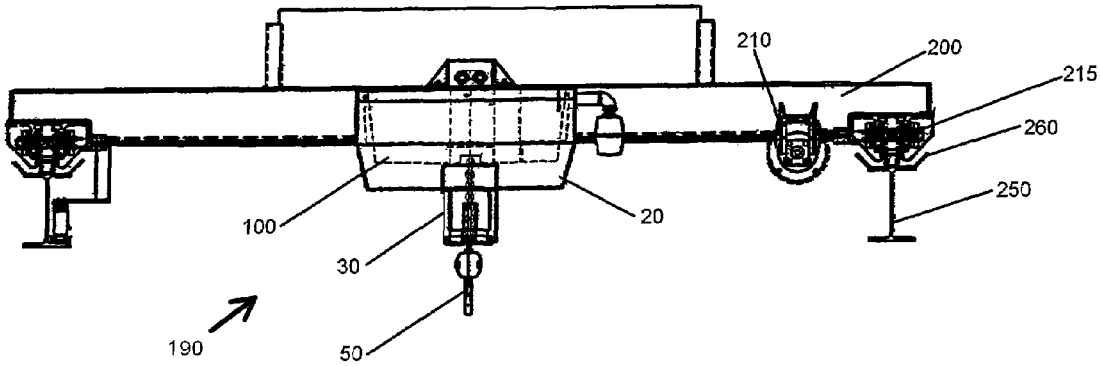
FIG. 5 is a front elevational view of the hoist cover assembly of FIG. 1 lug mounted to a bridge beam movable on top of runway beams.
Figure 6:
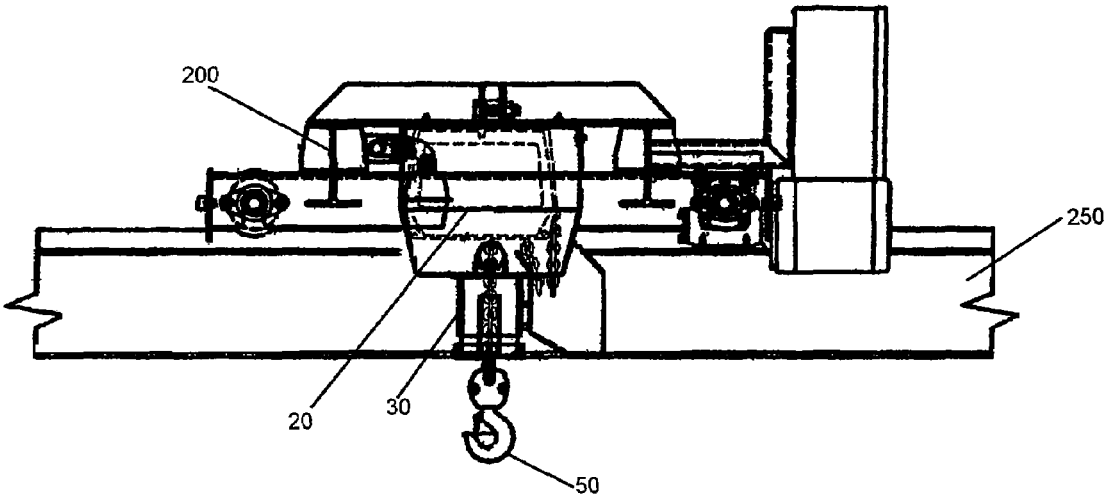
FIG. 6 is a side elevational view of the hoist cover assembly of FIG. 5.

Also, hoist 100 may be a component of a bridge crane assembly 190 which is movable along runway beams 250 to allow a load attached to rigging (e.g., rigging 40) of the hoist (e.g., hoist 100) to be moved within a room or building, for example a clean room of the building. For example, hoist cover 20 may be attached to a bridge beam 200 via a lug connection as depicted in FIGS. 5-6. Bridge beam 200 may be located in a clean room or clean zone, for example. Bridge beam 200 may run along runway beams 250 to allow hoist 100 to be manipulated transversely relative to runway beams 250, for example. A totally enclosed non-ventilated (TENV) motor (e.g., a motor 210) may drive bridge beam 200 along runway beams 250. The use of such TENV motors prevents or inhibits contaminants from such motors being introduced into a clean room. The motor gearbox of such a TENV may employ an expansion chamber (e.g., expansion chamber 70) as described above. Also, bridge beam 200 and runway beams 250 may be epoxy coated to minimize or eliminate the production of particulate emissions during use of hoist 100. For example, paint systems that pass ASTM E-595 may be used to coat the beams (e.g., "SHERWIN WILLIAMS" EPOXY MASTIC or equal incorporating a high gloss finish). Alternate coating and paint system comprised of a two-component, fully cross-linked epoxy or urethane, baked enamel coatings, fused powder coatings (epoxy or polyester) may also be used.

Bridge beams 200 and runway beams 250 may also include containment guards 260. In the example depicted in FIGS. 5-6, containment guards 260 are formed of the same material as runway beams 250 and at an angle upwardly relative to bridge beams 200 and runway beams 250 such that any material (e.g., particulates) generated from the movement of bridge beam 200 along runway beams 250 is maintained atop runway beams 250.

Figure 12:
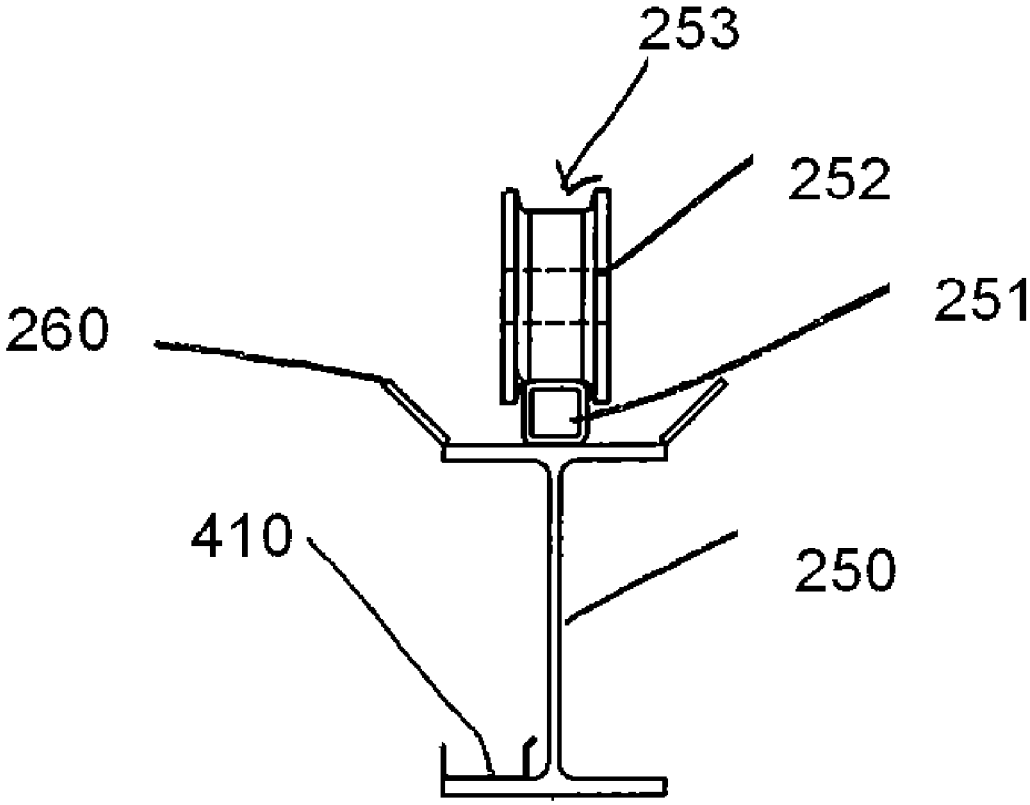
FIG. 12 is a side view of a runway beam including a rail and containment guards on a top side thereof along with a power distribution support tray on an inside bottom portion thereof.
Figure 13:
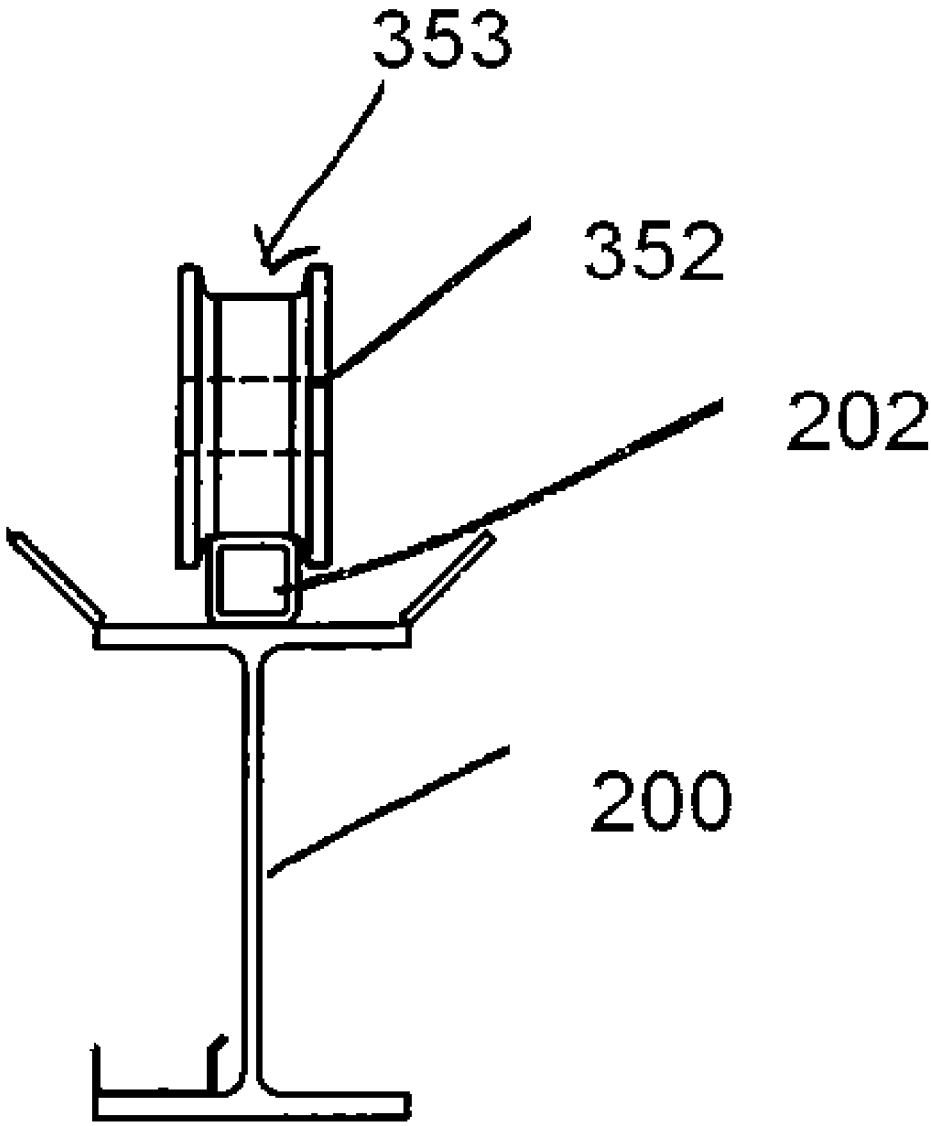
FIG. 13 is a side view of a bridge beam including a rail engaging a wheel of a hoist.

Also, bridge beam 200 and/or runway beam 250 may include a rail located on a top surface thereof to engage a wheel of hoist 100, trolley 310, or bridge beam 200 for example. For example, runway beam 250 may include a rail 251 for engaging a wheel of bridge beam 200. The wheels engaging the rails (e.g., rail 251) may be complimentary shaped relative thereto. In particular, as depicted in FIG. 12, a wheel 252 may include a groove 253 for receiving rail 251. In another example, a wheel (not shown) may have a convex portion for engaging with a rail (not shown) to minimize friction and lateral movement between the wheels and rails which could cause particulate formation (i.e., contamination). Further, rails of the beams described could be of any shape configured to engage wheels having grooves therein which are configured such that the wheels and rails interlock or are otherwise complimentary to each other. Also, bridge beam 200 may include a rail 202 for engaging a wheel 352 (e.g., of a hoist) having a groove 353 as depicted in FIG. 13. Bridge beam 200, rail 202, runway beam 250, rail 251, and/or wheels 215 may be formed of stainless steel. Alternatively, the beams, rails, wheels, and/or other moving, contacting and/or engaging parts of the crane assembly may be formed of TEFLON® material or Ultra High Molecular Weight Polyethylene, for example. The use of stainless steel, TEFLON or Ultra High Molecular Weight Polyethylene may minimize any particulate emissions from crane 190 if the crane were to be located in a clean room or clean zone. In one example, a beam (e.g., beam 250) may be coated as described above and a rail (e.g., rail 251) attached thereto may be formed of stainless steel. The use of stainless steel in contact with a wheel as described above may inhibit the production of contaminants (e.g., particulates) relative to coating such a rail, since the use of a coating in contact with a moving part (e.g., a wheel) may cause such coating to wear off and create such contamination. Also, lubricants necessary to be used in bearings and other moving parts of crane 190 may be LG2 "clean room" grease, as will be understood by those skilled in the art.

Figure 7:
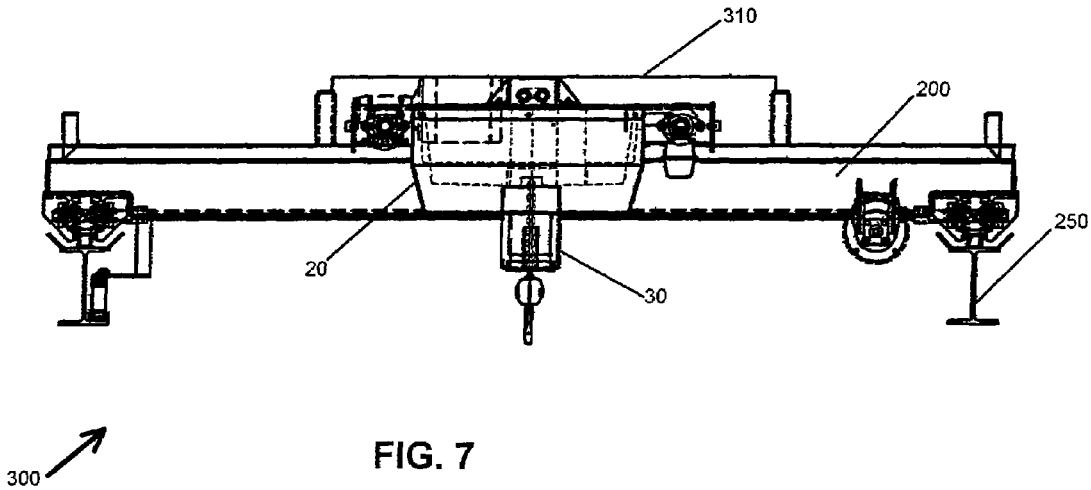
FIG. 7 is a front elevational view of the hoist cover assembly of FIG. 1 being lug mounted to a trolley movable on a bridge beam which is movable on runway beams.
Figure 8:
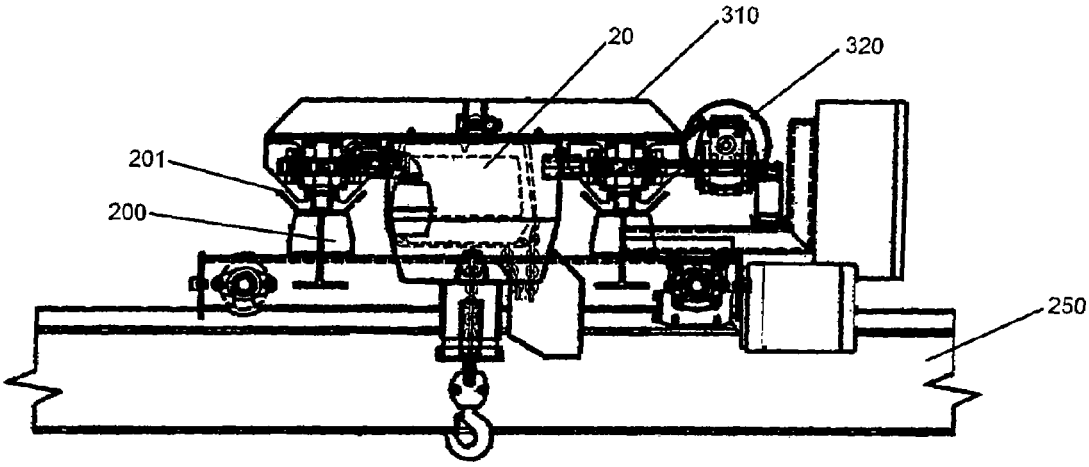
FIG. 8 is a side elevational view of the hoist assembly of FIG. 7.
Figure 9:
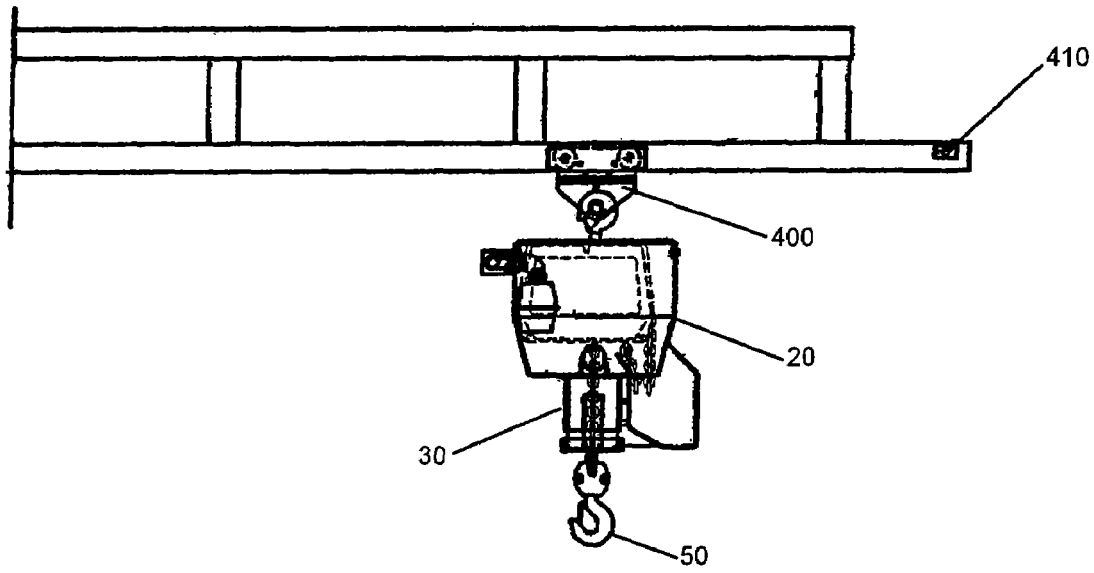
FIG. 9 is a side elevational view of the hoist assembly of FIG. 1 being engaged with a monorail.

FIGS. 7-8 depict hoist 100 being utilized on a crane assembly 300 which is similar to crane assembly 190 except that hoist cover 20 holding hoist 100 is attached to a top running trolley 310 which allows hoist 100 to be moved in a direction substantially perpendicular to runway beams 250 along bridge beams 200. Trolley 310 may be moved by a trolley motor 320 (e.g. a TENV motor) along bridge beams 200. The motor gearbox thereof may employ the use of an expansion chamber (e.g., expansion chamber 70) as described above. Bridge beams 200 may also include containment guards 201 as depicted in FIGS. 7-8. In another example depicted in FIG. 9, hoist 100 enclosed in hoist cover 20 and rigging cover 30 may be suspended from a trolley 400 movably connected to an enclosed track 410 (e.g., a bridge beam or monorail). As will be evident from the above description, hoist 100 enclosed in hoist cover 20 and cable cover 30 may be suspended from any number of systems which allow it to be manipulated and/or vertically supported to allow it to lift, lower, and/or move a load attached to attachment member 50 thereof while minimizing particulates production.

Also, the materials used to form hoist cover 20 and rigging cover 30 and the crane assemblies described may be resistant to flaking, shedding, off gassing and any other means of particulate production and may be approved to operate in a clean room class 10 (approximately equivalent to class 4 in Japanese Industrial Standard Criteria) and higher, and to be non-operationally located in a clean room class 1 (approximately equivalent to class 3 in Japanese Industrial Standard Criteria) and higher as per FIG. 10 taken from "Federal Standard 209E outlined in Airborne Particulate Cleanliness Classes in Clean Rooms and Clean Zones" described above. For example, the components of the crane assemblies may be formed of stainless steel, TEFLON® material, and/or ultra high molecular weight polyethylene. Also, certain portions of the crane assemblies may be coated with epoxy as described above to minimize particulate production during use thereof to meet the standards from Federal Standard 209E described. As also described, the motors utilized with such cranes and hoists may be totally enclosed non-ventilated (TENV) motors which also meet these standards for clean rooms and clean spaces.

Figure 11:
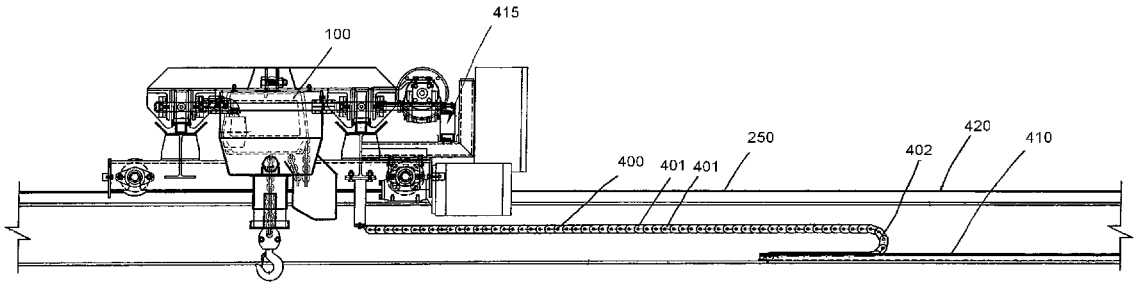
FIG. 11 is a side elevational view of the hoist assembly of FIG. 8 further including a power distribution track for feeding power conductors to a bridge crane.

Also, power may be provided to any power utilizing portions of the cranes and hoists described above (e.g., motor 210, the winch, trolley 310) may be provided utilizing a power distribution track such as a nylon coated cable track on a stainless steel support tray, for example. As depicted in FIG. 11, a power distribution track 400 may be received in a support tray 410 (e.g., a stainless steel support tray) mounted to a support beam 420 (e.g., runway beam 250). Also, a second power distribution track 415 may be aligned substantially perpendicular to power distribution track 400 to allow movement of trolley 310 in a direction substantially perpendicular to beam 250. In particular, the power distribution tracks include a plurality of individual portions (e.g., individual portions 401) which are movable as a power consuming device (e.g., a motor) moves along beams (e.g., beam 250) without entangling the power distribution tracks with other components or producing particulates which would cause contamination in a clean room, for example. As depicted in FIG. 11, power distribution track 400 may be curved at location 402 such that as individual portions 401 of power distribution track 400 move they may move around the curve and may be received on stainless steel support tray 410, for example.

It will be understood by those skilled in the art that crane assembly 190 (FIG. 5-6) or crane assembly 300 (FIG. 7-8) may be manufactured in various sizes and shapes to allow it to lift and move objects of various weights, sizes and shapes and to allow it to be utilized in various locations (e.g., clean rooms and clean zones). Also, it will be understood by those skilled in the art that although the above text describes and figures illustrate top-running overhead traveling cranes and under-running overhead traveling cranes, the invention described herein may be applied equally to between-running overhead traveling cranes. Also, it will be understood by those skilled in the art that the crane assemblies (e.g., crane assembly 190 and crane assembly 300) and hoists (e.g., hoist 100) may be powered in various ways including electrically, pneumatically, and any other means of powering such hoists and cranes known now or hereafter developed. Further, all components of the hoists and cranes described may meet the standards from Federal Standard 209E for clean rooms as described above.

Although preferred embodiments have been depicted and described in detail herein, it will be apparent to those skilled in the relevant art that various modifications, additions, substitutions and the like can be made without departing from the spirit of the invention and these are therefore considered to be within the scope of the invention as defined in the following claims.

The invention claimed is:

1. A hoist cover assembly for use in a clean room; the assembly comprising:

a hoist cover having a hoist cover cavity configured to receive a hoist body, said hoist cover comprising walls defining said hoist cover cavity, said walls configured to inhibit fluid communication between said hoist cover cavity and an exterior of said hoist cover walls; and a rigging cover having a rigging cavity configured to receive a rigging, the rigging coupled to the hoist body and an attaching member attachable to a load;

said rigging cover suspended from said hoist cover and being extendable in response to an extension of the rigging from the hoist body and retractable in response to a retraction of the rigging when the hoist body is received in the hoist cover and the rigging is received in the rigging cavity;

said rigging cover comprising a rigging cover wall defining said rigging cavity, said rigging cover wall configured to inhibit fluid communication between said rigging cavity and an exterior of said rigging cover wall;

means for movably connecting said hoist cover to a support beam to allow said hoist cover and said rigging cover to be selectively located within the clean room; and an expansion chamber in fluid communication with said hoist body, said expansion chamber comprising a bladder expandable and contractible in response to a change of a volume of fluid in said hoist body.

2. The assembly of claim 1 wherein the hoist body comprises a winch configured to at least one of raise and lower the rigging and the attaching member.

3. The assembly of claim 1 wherein said expansion chamber comprises a conduit connectable to a vent of the hoist body when the hoist body is received in said hoist cover cavity.

4. The assembly of claim 1 wherein said rigging cover comprises a telescoping rigging cover.

5. The assembly of claim 1 wherein said rigging cover further comprises a rigging cover pilot connectable to at least one of the attaching member and the rigging such that said rigging cover extends in response to an extension of the at least one of the attaching member and the rigging.

6. The assembly of claim 1 wherein said hoist cover further comprises a sight glass to allow said hoist cover cavity to be viewed from an exterior of said hoist cover.

7. A hoist assembly for use on a clean room crane, the hoist assembly comprising:

a hoist body received in a hoist cover cavity of a hoist cover, the hoist cover inhibiting fluid communication between the hoist cover cavity and the clean room to inhibit movement of contamination from the hoist cover cavity to the clean room;

a rigging coupled to said hoist body and to an attaching member attachable to a load;

said rigging received in a rigging cavity of a rigging cover, said rigging cover comprising rigging cover walls inhibiting fluid communication between said rigging cavity and the clean room to inhibit movement of contamination from the rigging cavity to the clean room;

said rigging cover suspended from said hoist cover;

said rigging cover having a pilot having an opening therein, said rigging extending through said opening and said rigging connected to said attaching member through said opening, said pilot connected to said rigging and said rigging cover extendable in response to an extension of said rigging from said hoist body, said rigging cover retractable in response to a retraction of said rigging;

wherein said hoist cover comprises walls defining said hoist cover cavity, said walls configured to inhibit fluid communication between said hoist cover cavity and an exterior of said walls; and an expansion chamber in fluid communication with said hoist body and comprising a bladder expandable and contractible in response to a change of a volume of fluid in said hoist body.

8. The assembly of claim 7 wherein said hoist body comprises a winch configured to at least one of raise and lower said rigging and said attaching member.

9. The assembly of claim 7 wherein said chamber comprises a conduit connectable to a vent of the hoist.

10. The assembly of claim 7 wherein said rigging cover comprises a telescopic rigging cover.

11. The assembly of claim 7 wherein said rigging cover comprises rigging cover walls defining said rigging cavity, said rigging cover walls configured to inhibit fluid communication between said rigging cavity and an exterior of said rigging cover walls.

12. The assembly of claim 7 wherein said rigging cover further comprises a rigging cover pilot connected to at least one of said attaching member and said rigging such that said rigging cover extends in response to an extension of said at least one of said attaching member and said rigging.

13. The assembly of claim 7 wherein said hoist cover further comprises a sight glass to allow said hoist to be viewed from an exterior of said hoist cover.

14. The assembly of claim 7 further comprising at least one beam of an overhead traveling crane coupled to said hoist.

15. The assembly of claim 7 wherein said hoist is movably attached to said at least one beam.

* * * * *